US006454028B1

(12) United States Patent
Evans

(10) Patent No.: US 6,454,028 B1
(45) Date of Patent: Sep. 24, 2002

(54) WEAR RESISTANT DRILL BIT

(75) Inventor: Stephen M. Evans, Standish (GB)

(73) Assignee: Camco International (U.K.) Limited (GB)

( * ) Notice: Subject to any disclaimer, the term of this patent is extended or adjusted under 35 U.S.C. 154(b) by 0 days.

(21) Appl. No.: 09/754,434

(22) Filed: Jan. 4, 2001

(51) Int. Cl.[7] ..... E21B 10/00
(52) U.S. Cl. ..... 175/379; 175/380; 175/425
(58) Field of Search ..... 175/327, 379, 175/380, 414, 415, 425

(56) References Cited

U.S. PATENT DOCUMENTS 4,884,477 A * 12/1989 Smith et al.
5,090,491 A * 2/1992 Tibbitts et al.
6,092,613 A 7/2000 Caraway et al.
6,116,360 A 9/2000 Evans

* cited by examiner

*Primary Examiner*—Roger Schoeppel
(74) *Attorney, Agent, or Firm*—Jeffery E. Daly

(57) ABSTRACT

A wear resistant drill bit of the matrix bodied type has a bit body comprising a tungsten carbide material bound with a binder material, wherein the tungsten carbide material includes at least some tungsten carbide particles of generally spherical shape. The tungsten carbide material includes particles having a relatively hard central core and a softer skin. The skin includes a large proportion of a high temperature phase of tungsten carbide.

18 Claims, 1 Drawing Sheet

WEAR RESISTANT DRILL BIT

BACKGROUND OF THE INVENTION

1. Field of the Invention

This invention relates to a wear resistant drill bit for use in the formation of subterranean well bores.

2. Description of the Related Art

In order to maximize drilling efficiency it is important to minimize the down-time of a drilling rig which occurs when a bit requires replacement, and the frequency with which bits require replacement. Clearly, improving the ability of a drill bit to withstand the wear which occurs in use will reduce the frequency of bit replacement and so is advantageous. A number of techniques for improving the wear resistance of a drill bit are known. For example it is known to mount wear resistant components on the exterior of a steel bodied drill bit, as described in U.S. Pat. No. 6,092,613, or to apply a coating of a suitably wear resistant material to the drill bit. These techniques are used, primarily, with drill bits having bodies formed from cast or machined steel.

In another type of drill bit, the bit body is formed from one or more powders secured in a matrix by a binder material. Typically, with drill bit bodies of the matrix type, either a macrocrystalline tungsten carbide material is used in the matrix, or a crushed, cast tungsten carbide material is used. Both of these materials are thought to have advantages and disadvantages.

The use of the crushed, cast material results in the formation of matrix bit bodies of good erosion resistance but relatively low fatigue strength. Matrix bit bodies formed using the macrocrystalline material have a lower erosion resistance but improved fatigue strength. By way of example, the erosion resistance of a matrix bit body formed using the cast and crushed material is typically approximately five times that of a body formed using the macrocrystalline material, but has a fatigue strength of only about 40% of that of a body formed using the macrocrystalline material.

The reasons for these properties are thought to be that the crushed cast tungsten carbide takes the form of a mixture of WC and W2C whereas the macrocrystalline material consists only of WC. W2C is harder than WC and so the crushed cast material is more capable of withstanding abrasion or erosion than the macrocrystalline material. Further, the cast, crushed material is made up of particles of uneven shape with irregular and angular surfaces giving rise to a larger surface area than the macrocrystalline material, which is made up of crystals of a more regular, blocky form which have smooth surfaces. As a result, the chemical or metallurgical bond between the crushed, cast material and a binder material is somewhat stronger than that between the macrocrystalline material and the binder material. Mechanical locking of the crushed cast material to the binder is also good. These effects assist in improving the erosion resistance of a drill bit. The fatigue strength of the crushed cast material is thought to be lower than that of the macrocrystalline material as the crushing process induces small cracks in the material. In use of a drill bit, small cracks propagating through the binder to the tungsten carbide material may be able to propagate along and extend the cracks already present in the crushed cast tungsten carbide material. In drill bits manufactured using the macrocrystalline material, such cracks are not present in the tungsten carbide material and cracks forming within the binder must pass around rather than through the tungsten carbide material.

BRIEF SUMMARY OF THE INVENTION

It is an object of the invention to provide a drill bit having an improved wear resistance compared to drill bits manufactured using the materials mentioned above.

According to a first aspect of the invention there is provided a drill bit of the matrix type having a bit body comprising a tungsten carbide material bound with a binder material, wherein the tungsten carbide material includes at least some tungsten carbide particles of generally spherical shape.

The, generally spherical tungsten carbide particles are preferably of a type having a relatively hard central core and an outer skin of relatively low hardness. The outer skin conveniently includes a high temperature form of tungsten carbide which is relatively ductile and is amenable to wetting by the binder material. The outer surface of the sphere is generally quite rough, providing a much greater surface area for bonding by the binder than the generally smooth surfaces of crushed and macrocrystalline tungsten carbide.

The use of particles of generally spherical form permits an increase in the density with which the particles can be packed in a mold during the manufacturing process. The use of particles of the type having a relatively hard central core and a relatively soft, ductile outer skin results in the drill bit being of good abrasion resistance (as the core is hard) and good fatigue strength.

According to another aspect of the invention there is provided a drill bit of the matrix type having a bit body comprising a tungsten carbide material bound by a binder material, wherein the tungsten carbide material comprises at least some particles having a relatively hard central core and a softer, relatively ductile outer skin.

The central core conveniently has a hardness of at least 2000HV100, the hardness preferably being approximately 2100HV100. The outer skin preferably has a hardness falling within the range 1250-1750HV100, and is conveniently approximately 1500HV100.

According to another aspect of the invention there is provided a drill bit of the matrix type having a bit body comprising a tungsten carbide material bound by a binder material, wherein the tungsten carbide material includes at least some particles which include a high temperature phase of tungsten carbide.

BRIEF DESCRIPTION OF THE DRAWINGS

The invention will further be described, by way of example, with reference to the accompanying drawings, in which.

DETAILED DESCRIPTION OF THE INVENTION AND THE PREFERRED EMBODIMENT

Figure 1:
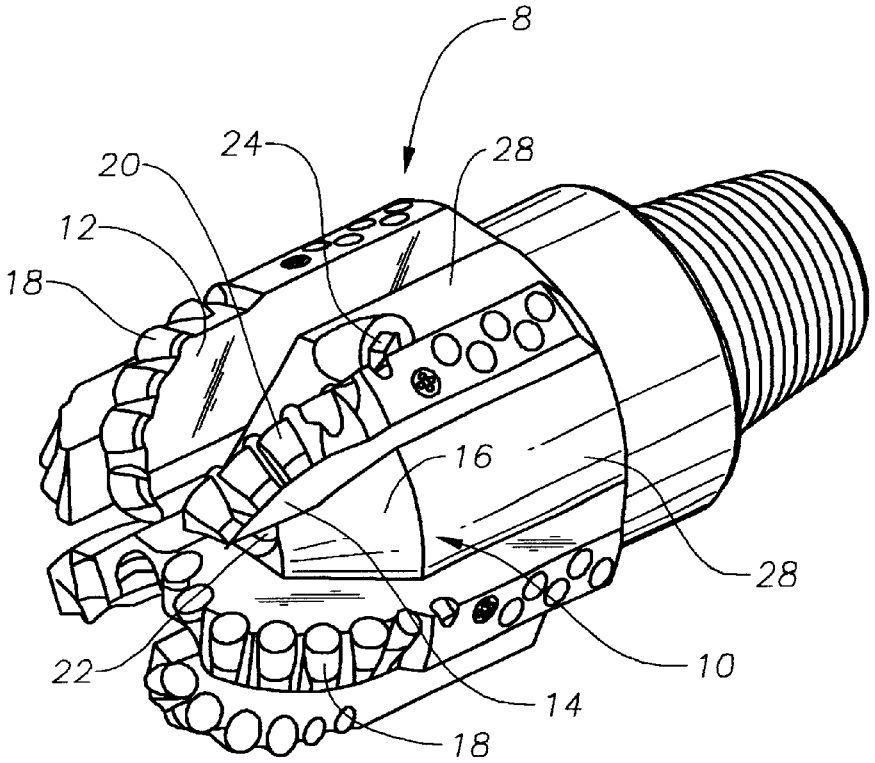
FIG. 1 is a perspective view of a drill bit.

Referring to FIG. 1, the matrix bodied drill bit 8 comprises a bit body 10 having a leading face formed with six blades extending outwardly away from the axis of the body towards the gauge region. The blades comprise three longer primary blades 12 alternately spaced with three shorter secondary blades 14. Between adjacent blades there are defined fluid channels 16.

Extending side by side along each of the primary blades 12 is a plurality of primary cutters 18 and extending along each of the secondary blades 14 is a plurality of secondary cutters 20. The precise nature of the cutters does not form a part of the present invention and they may be of any appropriate type. For example, as shown, they may comprise circular preformed cutting elements brazed to cylindrical carriers which are embedded or otherwise mounted in the blades, the cutting elements each comprising a preformed compact having a polycrystalline diamond front cutting table bonded to a tungsten carbide substrate, the compact being brazed to a cylindrical tungsten carbide carrier. Alternatively, substrate of the preformed compact may itself be of sufficient length to be mounted directly in the blade, the additional carrier then being omitted.

The secondary cutters 20 may be of the same type as the primary cutters 18 or the primary and secondary cutters may be of different types.

Inner nozzles 22 are mounted in the surface of the bit body and are located in a central region of the bit body 10, fairly close to the axis of rotation of the drill bit. Each inner nozzle 22 is so located that it can deliver drilling fluid to two or more of the channels 16, but is so orientated that it primarily delivers drilling fluid outwardly along a channel 16 on the leading side of one of the three primary blades 12.

In addition, outer nozzles 24 are located at the outer extremity of each channel on the leading side of each secondary blade 14. The outer nozzles are orientated to direct drilling fluid inwardly along their respective channels towards the center of the drill bit, such inwardly flowing drilling fluid becoming entrained with the drilling fluid from the associated inner nozzle 22 so as to flow outwardly to the gauge region again along the adjacent channel. All the nozzles communicate with a central axial passage (not shown) in the shank of the bit to which drilling fluid is supplied under pressure downwardly through the drill string in known manner.

The outer extremities of the blades 12, 14 are formed with kickers 26 which provide part-cylindrical bearing surfaces which, in use, bear against the surrounding wall of the bore hole and stabilize the bit in the bore hole. Abrasion-resistant bearing elements (not shown), of any suitable known form, are embedded in the bearing surfaces.

Each of the channels 16 between the buds leads to a respective junk slot 28. The junk slots extend upwardly between the outer extremities of the blades 12, 14, so that drilling fluid flowing outwardly along each channel passes into the associated junk slot and flows upwardly, between the bit body 10 and the surrounding formation, into the annulus between the drill string and the wall of the bore hole.

In operation, the bit body 10 is rotated from the surface while weight is applied to the bit body 10, causing the cutters 18, 20 on the blades 12, 14 to engage the earth, effecting a cutting or drilling action, as is well known in the earth boring drill bit industry. Although a particular design of a drill bit 8 is illustrated, it would be appreciated that many different forms of drill bits 8 may be made. These may be, but are not limited to, matrix bodied drill bits 8 without blades, bi-center type drill bits, or drill bits 8 with natural or synthetic diamonds or other superhard material embedded in and/or beneath the surface of the bit body 10 in place of the cutters 18, 20.

The bit body 10 is of the matrix type and is manufactured by placing particles 30 of tungsten carbide and optionally other materials such as tungsten powder, diamond or other superhard particles, and a suitable infiltrant, within a mold, and heating the mold and its contents to cause the infiltrant to infiltrate the matrix material and to cause the particles of tungsten carbide and other powders to bond together to form a solid body matrix. The details of matrix bit molding and manufacture are well known in the industry, and are described in U.S. Pat. No. 6,116,360 herein incorporated by reference for all it discloses.

Figure 2:
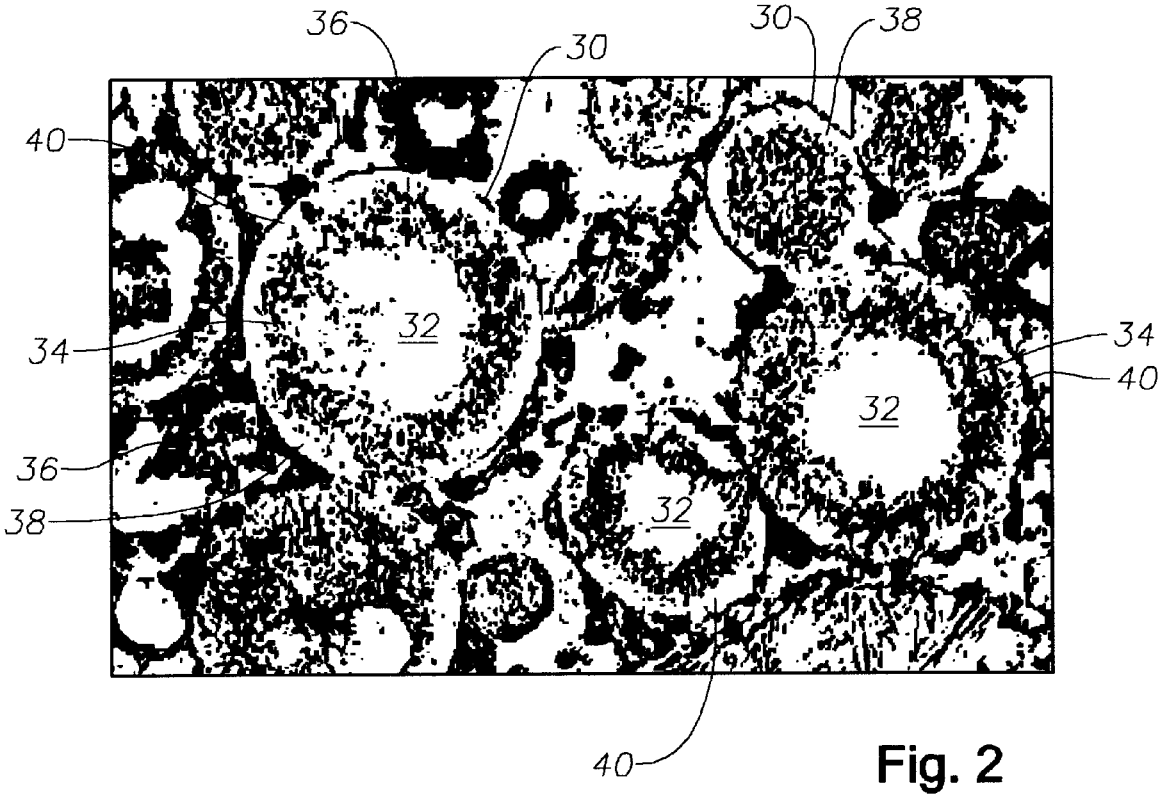
FIG. 2 is a photomicrograph of the matrix of the bit body of the drill bit illustrated in FIG. 1.

FIG. 2 is a photomicrograph of the matrix of the bit body 10. As shown in FIG. 2, the matrix contains particles 30 of tungsten carbide bound together by a suitable binder material 36. The particles 30 are of generally spherical form and are manufactured by a process whereby small droplets of molten tungsten carbide are cooled very rapidly. The rapid cooling results in the particles 30 being of an unusual form, the particles 30 each including a relatively hard central core 32 surrounded by an outer skin 34 which is less hard and more ductile than the central core 32.

The particles 30 have a relatively large surface area and are rough, thus metallurgical bonding and mechanical gripping between the particles and the binder material 36 are good. The rough outer surface 38, 40 of the particles 30 provides a much greater surface area, and therefore greater bond strength than the relatively smooth surfaces of crushed or macrocrystalline tungsten carbide.

The central core 32 is typically of hardness approximately 2100HV100 giving rise to good erosion or abrasion resistance. The outer skin 34 contains a relatively large proportion of a high temperature phase of tungsten carbide which is relatively ductile and also has a crystallographic structure which is amenable to wetting by the infiltrant material, thus assisting in the formation of good bonds between the particles 30 and the binder material 36. The outer skin 34 is typically of hardness approximately 1500HV100.

The tungsten carbide material used results in the bit body having an erosion resistance approximately ten times that of a body formed using the macrocrystalline material, and a fatigue strength of approximately twice that of such a body.

In addition to the advantages associated with the crystallographic structure of the particles 30, the spherical shape of the particles 30 results in an increase in the density with which the particles 30 can be packed into the mold during manufacture. Further, in use, the spherical shape tends to deflect abrasive materials away from the particles. The particles 30 are also of good thermal stability and maintain their hardness to very high temperatures.

It will be appreciated that, although described with reference to a particular type of drill bit body, the invention is also applicable to drill bit bodies of a range of other designs.

Whereas the present invention has been described in particular relation to the drawings attached hereto, it should be understood that other and further modifications apart from those shown or suggested herein, may be made within the scope and spirit of the present invention.

What is claimed is:

1. A matrix bodied drill bit having a bit body comprising a tungsten carbide material bound with a binder material, wherein the tungsten carbide material includes at least some tungsten carbide particles of generally spherical shape which have a central core and an outer skin wherein the central core is substantial harder than the outer skin.

2. The matrix bodied drill bit of claim 1, wherein the tungsten carbide particles of generally spherical shape have a rough outside surface with a surface area greater than that of a smooth sphere.

3. The matrix bodied drill bit of claim 1, wherein the outer skin includes a high temperature form of tungsten carbide which is amenable to wetting by the binder material.

4. A matrix bodied drill bit having a bit body comprising a tungsten carbide material bound by a binder material, wherein the tungsten carbide material comprises at least some particles having a central core and an outer skin, wherein the central core is substantially harder the outer skin, and the outer skin is substantially more ductile than the central core.

5. The matrix bodied drill bit of claim 4, wherein the central core has a hardness of at least 2000HV100.

6. The matrix bodied drill bit of claim 5, wherein the hardness of the central core is approximately 2100HV100.

7. The matrix bodied drill bit of claim 4, wherein the outer skin has a hardness falling within the range 1250–1750HV100.

8. The matrix bodied drill bit of claim 7, wherein the outer skin has a hardness of approximately 1500HV100.

9. A matrix bodied drill bit having a bit body comprising a tungsten carbide material bound by a binder material, wherein the tungsten carbide material includes at least some particles which include a high temperature phase of tungsten carbide.

10. The matrix bodied drill bit of claim 9 wherein the particles have a generally spherical shape and a central core and an outer skin, wherein the central core is substantially harder than the outer skin.

11. The matrix bodied drill bit of claim 10, wherein the particles have a rough outside surface with a surface area greater than that of a smooth sphere.

12. A drill bit body comprising an infiltrated matrix of a binder material and a tungsten carbide material, wherein the tungsten carbide material includes at least some particles which include a high temperature phase of tungsten carbide.

13. The drill bit body of claim 12 wherein the particles have a generally spherical shape and a central core and an outer skin, wherein the central core is substantially harder than the outer skin.

14. The drill bit body of claim 13, wherein the particles have a rough outside surface with a surface area greater than that of a smooth sphere.

15. The matrix bodied drill bit of claim 1, wherein the central core has a hardness at least 250HV100 higher than the outer skin.

16. The matrix bodied drill bit of claim 4, wherein the central core has a hardness at least 250HV100 higher than the outer skin.

17. The matrix bodied drill bit of claim 10, wherein the central core has a hardness at least 250HV100 higher than the outer skin.

18. The drill bit body of claim 13, wherein the central core has a hardness at least 250HV100 higher than the outer skin.

* * * * *